US007077922B2

(12) United States Patent
Brandt et al.

(10) Patent No.: US 7,077,922 B2
(45) Date of Patent: Jul. 18, 2006

(54) TECHNIQUE TO FILL SILENCERS

(75) Inventors: Luc Brandt, Henri-Chapelle (BE); Jean-Pierre Caron, Verviers (BE)

(73) Assignee: Owens Corning Composites S.P.R.L., Brussels (BE)

( * ) Notice: Subject to any disclaimer, the term of this patent is extended or adjusted under 35 U.S.C. 154(b) by 138 days.

(21) Appl. No.: 10/613,873

(22) Filed: Jul. 2, 2003

(65) Prior Publication Data

US 2005/0001012 A1 Jan. 6, 2005

(51) Int. Cl.
*B32B 37/00* (2006.01)

(52) U.S. Cl. ..... 156/73.1; 156/169; 29/890.08; 181/252; 181/257

(58) Field of Classification Search ..... 156/73.1, 156/166, 169, 170, 171, 172, 173, 174, 175, 156/580.1, 580.2; 29/890.08, 890.053; 181/252, 181/256, 257, 258

See application file for complete search history.

(56) References Cited

U.S. PATENT DOCUMENTS

| | | | | |
|---|---|---|---|---|
| 4,121,686 | A | 10/1978 | Keller, Jr. | |
| 4,569,471 | A | 2/1986 | Ingemansson et al. | |
| 4,774,985 | A | 10/1988 | Broadbelt et al. | |
| 5,926,954 | A | 7/1999 | Wolf et al. | |
| 6,053,276 | A | 4/2000 | D'Amico, Jr. et al. | |
| 6,094,817 | A | 8/2000 | Shah et al. | |
| 6,148,519 | A | 11/2000 | Stenersen et al. | |
| 6,148,955 | A | 11/2000 | Wolf et al. | |
| 6,158,547 | A | 12/2000 | Ackermann et al. | |
| 6,196,351 | B1 | 3/2001 | Clokey et al. | |
| 6,317,959 | B1 | 11/2001 | Nilsson et al. | |
| 6,319,444 | B1 | 11/2001 | Kirk | |
| 6,370,747 | B1 | 4/2002 | Lewin et al. | |
| 6,412,596 | B1 | 7/2002 | Brandt et al. | |
| 6,446,750 | B1 | 9/2002 | Lewin | |
| 6,467,571 | B1 | 10/2002 | Nakagawa | |
| 6,581,723 | B1 * | 6/2003 | Brandt et al. | 181/256 |
| 6,607,052 | B1 * | 8/2003 | Brandt et al. | 181/256 |
| 2002/0129991 | A1 | 9/2002 | Lewin | |

FOREIGN PATENT DOCUMENTS

| | | |
|---|---|---|
| EP | 0-434 895 | 3/1991 |
| JP | 04-036013 | 2/1992 |

* cited by examiner

*Primary Examiner*—James Sells
(74) *Attorney, Agent, or Firm*—Inger H. Eckert; Margaret S. Millikin; Maria C. Gasaway

(57) ABSTRACT

A method for forming odd-shaped mufflers is achieved by first introducing an unfilled muffler insert having a desired number of pipes and partitions within a two-piece shaped tool. Fibrous material is introduced within desired compartments formed between the shaped tool and unfilled insert to form a filled insert. The shaped tool and filled insert are then placed on a winding device. A yarn thread is then wound and secured around the fibrous material within a gap created between the two pieces of the shaped tool. The winding device and shaped tool are then removed from the filled and wound muffler insert. The wound and filled muffler insert may then either be pressed into a previously formed muffler shell, or alternatively, the muffler shell may be formed around the wound and filled muffler insert to form the muffler.

20 Claims, 5 Drawing Sheets

TECHNIQUE TO FILL SILENCERS

TECHNICAL FIELD AND INDUSTRIAL APPLICABILITY OF THE INVENTION

This invention relates to a process for filling a silencer with fibrous material as well as a silencer filled with fibrous material.

BACKGROUND OF THE INVENTION

U.S. Pat. No. 4,569,471 to Ingemansson et al. describes a process and apparatus for feeding lengths of a continuous glass fiber strand into a muffler outer shell. The apparatus includes a nozzle for expanding the fiber strand into a wool-like material before the material enters the outer shell. In a first embodiment, filling of an outer cylinder of the muffler shell occurs without an end-piece joined to the outer cylinder. After the filling operation is completed, the outer cylinder is moved to a separate station where the end piece is welded onto the outer cylinder. During movement of outer cylinder, a vacuum device may remain coupled to the outer cylinder or a cover is placed over the filled outer cylinder so as to prevent the wool-like material from coming out during transport, see column 4, lines 1–7. During the closure process, great care must be taken to ensure that glass fiber material does not extend into the joint area.

In a second embodiment, a perforated pipe/outer end piece assembly is positioned only part way into the muffler outer cylinder during the glass material filling operation. After the filling operation has been completed, the perforated pipe/end piece assembly is moved to its final position within the outer cylinder.

While the technology of Ingemansson et al. improved many aspects of muffler technology, it does have certain drawbacks. For example, the filling of the interior of the muffler, or sections of the interior of the muffler, is typically limited to certain geometries. Thus, for example, mufflers having odd shapes, such as clamshell mufflers, are difficult to fill using the current technology.

Further, the filling of the interior region must be done after the build-out of an entire muffler cavity, including the introduction and fixing of the internal mechanical parts (tubes and partitions) within the outer shell of the muffler. As stated above, this thus limits the filling of the sections of the interior of the muffler due to space constraints and other considerations.

SUMMARY OF THE INVENTION

This need is met by the present invention; wherein a process is provided for filling odd-shaped silencers without having to build an entire muffler cavity wherein the fibers should be placed in their final stage.

In accordance with the present invention, a process is provided for filling a muffler with fibrous material. The process comprises the steps of: providing a muffler insert that is placed in an appropriately designed shaped tool with at least one fill opening; feeding fibrous material into the within the cavity formed between the inserts and tool through the at least one fill opening; coupling an outer yarn thread onto the outer periphery of the fibrous volume to compress the wool to the muffler inserts; removing the tool while the outer yarn thread is being wound around the fibrous material; welding or otherwise affixing the yarn onto previously wound yarns if desired; retrieving the filled insert from the tool; and introducing the filled insert within the muffler body.

The feeding step may comprise the steps of: providing a nozzle; feeding continuous strand material and pressurized air into the nozzle such that a wool-type product emerges from the nozzle; and positioning the nozzle adjacent to or in the fill opening such that the wool-type product is fed through the fill opening and into cavity.

The continuous strand material comprises one more strands each comprising a plurality of glass filaments which may be selected from the group consisting of E-glass filaments and S-glass filaments. Preferably, the continuous strand material comprises an E-glass roving sold by Owens Coming under the trademark ADVANTEX® or an S-glass roving sold by Owens Coming under the trademark Zentron®.

The yarn winding material preferably comprises one or more strands of polymer based yarn materials and allows a precise positioning of the continuous strand material with respect to the metallic inserts. The behavior of the wound yarn against temperature is selected to provide optimal tensile strength at room temperature and lowest possible tensile strength at elevated temperatures. In this way, the first vehicle use will result in disintegration of the winding yarn.

Alternatively, the winding yarn may comprise a steel type of yarn, which maintains the fibrous material in a compressed state against the unfilled muffler insert. This creates a double layer acoustical effect of compressed glass fiber and air. This effective reduces costs of raw materials used for acoustical purposes.

In another alternative embodiment, the present invention may be used in applications requiring a fiber-encased blank coupled and consolidated with fibrous material, which expands after a first temperature peak. In this invention, the wool type product and wound yarn is introduced around a metal or plastic blank in a manner as described above. The fiber-encased blank may then be introduced into many applications.

Other features, benefits and advantages of the present invention will become apparent from the following description of the invention, when viewed in accordance with the attached drawings and appended claims.

DETAILED DESCRIPTION AND PREFERRED EMBODIMENTS OF THE INVENTION

Figure 1:
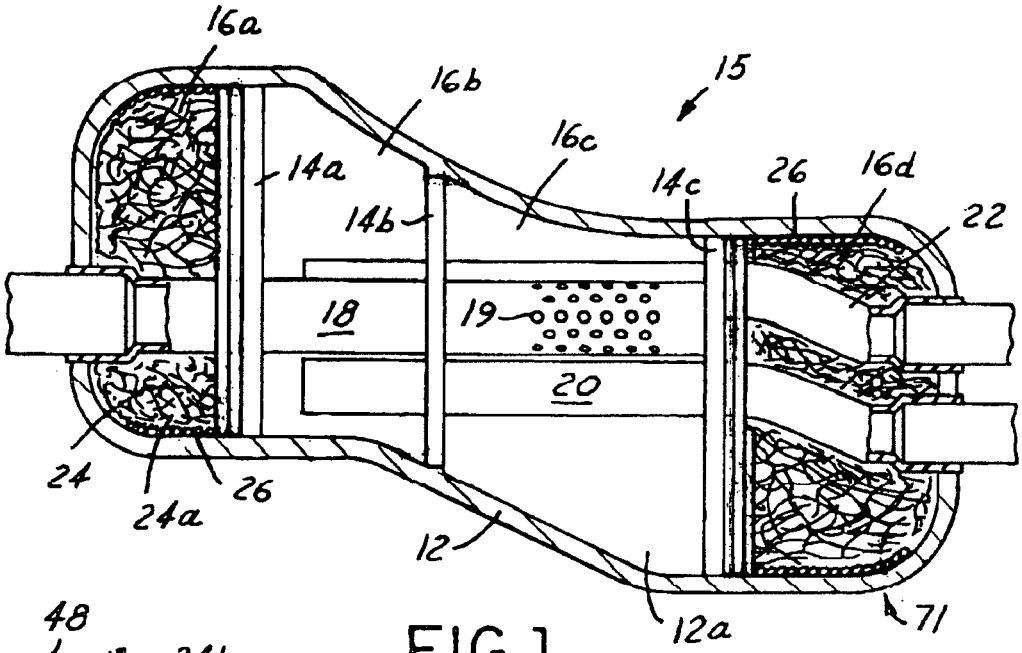
FIG. 1 illustrates a muffler constructed in accordance with a first embodiment of the present invention having an outer shell shown partially in cross-section and with portions partially removed and a first perforated pipe with a fill opening into which a fibrous material filling nozzle extends.

A process is provided for filling a muffler with fibrous material. Mufflers filled in accordance with the present invention are capable of being incorporated into vehicle exhaust systems and function as acoustic energy dissipaters (sound dampeners). Referring now to FIG. 1, a muffler 15 is illustrated which is capable of being filled in accordance with a first embodiment of the present invention. The muffler 15 comprises a closed outer shell 12 having first, second and third partitions 14*a*–14*c* which define first, second, third and fourth internal compartments 16*a*–16*d* of an inner cavity 12*a* within the muffler shell 12. A "closed muffler shell" as used herein means a single element muffler shell or a shell formed from two or more elements which are welded or otherwise coupled together such that they are not intended to be opened after introduction of a fibrous filling material 24. The muffler 15 further comprises first, second and third perforated pipes 18, 20 and 22. In the illustrated embodiment, the partitions 14*a*–14*c* include a plurality of openings 14*d* permitting gases to pass between the compartments 16*a*–16*d*. Further in the illustrated embodiment, the first, second and third pipes 18, 20 and 22 include first openings 19 having a cross sectional area of from about 5.0 $mm^2$ to about 25.0 $mm^2$. The openings 19 in the pipes 18, 20 and 22 allow gases to pass into one or more of the compartments 16*a*–16*d*. The openings 19 may also contribute to the exchange of acoustic pressure between the pipes 18, 20, 22 and the respective compartments 16*a*–*d*. Any or all of the compartments 16*a*–16*d* are filled with a fibrous material 24 that defines a wool-type product 24*a* in those compartments 16*a*–16*d*. The wool-type product 24*a* is surrounded by a filament or winding yarn 26 to form a filled and wound muffler insert 71, the importance of which will be described in detail below.

During operation of a vehicle to which the muffler 15 is coupled, acoustic energy passes through and from the perforated pipes 18, 20 and 22 to the wool-type product 24*a* which functions to dissipate a portion of the acoustic energy. The product 24*a* may potentially function to thermally insulate the outer shell 12 from energy in the form of heat transferred from high temperature exhaust gases passing through the pipes 18, 20 and 22.

One preferred offline process for forming filled muffler insert 70 is shown below in FIG. 2. This filled muffler insert 70 maybe subsequently wound with a yarn thread 26 to form a filled and wound muffler insert 71, which forms the interior of the muffler 15 within the muffler shell 12, as described below in FIGS. 10 and 11.

Figure 2:
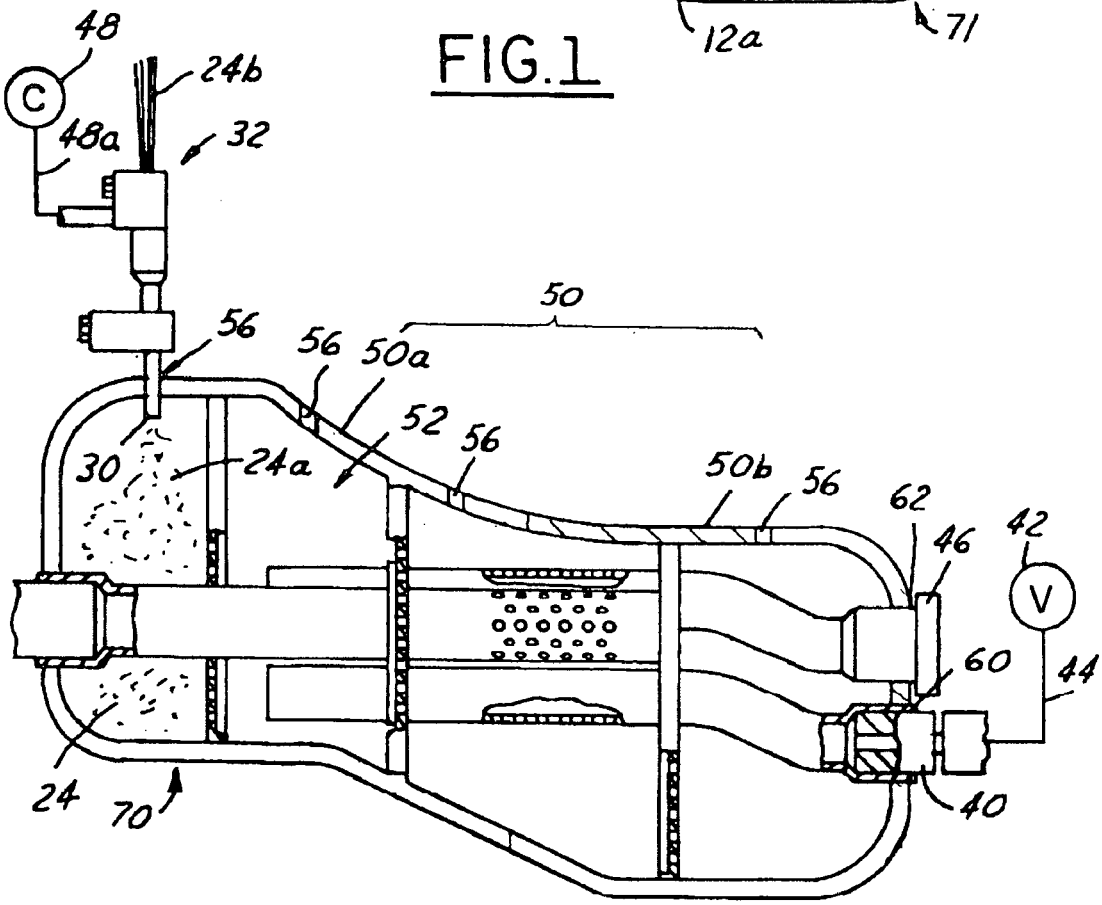
FIG. 2 is a perspective view of the shaped tool and muffler insert used to form the filled and wrapped muffler insert of FIG. 1.

Referring now to FIG. 2, a shaped tool 50 is provided that contains an unfilled muffler insert 52 consisting of the first, second and third partitions 14*a*–14*c* and first, second and third perforated pipes 18, 20 and 22. Compartments 16*a*–16*d* are created between the shaped tool 50 and unfilled muffler insert 52. The shaped tool 50 has fill openings 56 corresponding to each created compartment 16*a*–16*d* wherein the fibrous material 24 may be introduced. The shaped tool 50 preferably has a top portion 50*a* and a bottom portion 50*b*, the importance of which will be described further below in FIGS. 10 and 11.

While the unfilled muffler insert 52 of FIG. 2 is shown in one possible configuration, it is understood that many other possible configurations are possible, thus allowing mufflers of a wide variety of shapes and sizes to be easily produced using the same process. The number of possible configurations is potentially limitless and is dependent upon numerous factors, including but not limited to, the size of vehicle in which the muffler 15 is installed and the desired acoustical properties derived from the muffler 15. Some of the possibilities are shown in FIGS. 3–7.

Figure 3:
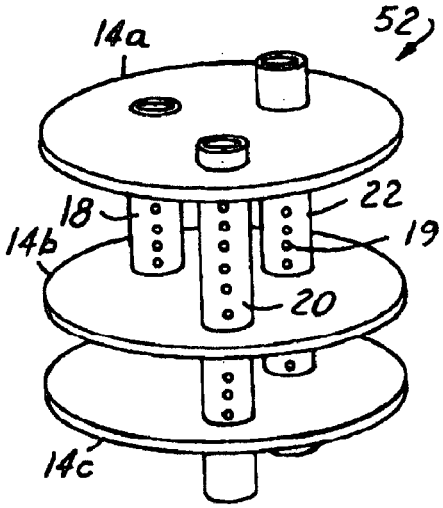
FIGS. 3–7 are perspective views of unfilled muffler inserts according to alternative preferred embodiments of the present invention.
Figure 4:
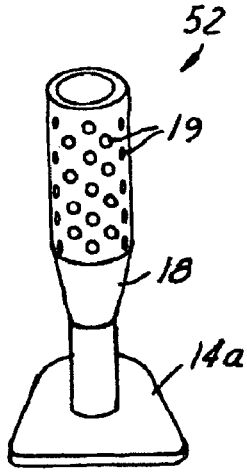
Figure 5:
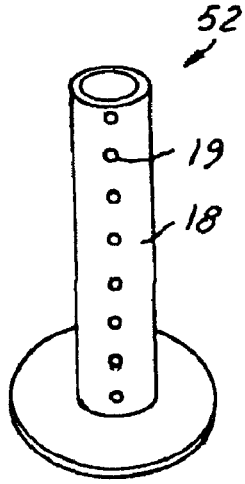
Figure 6:
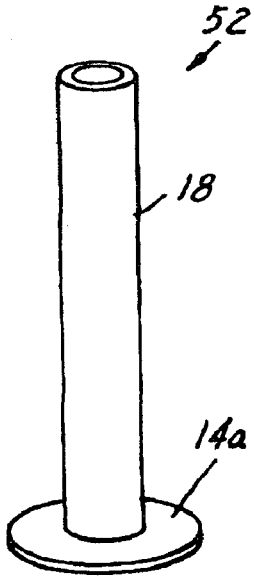
Figure 7:
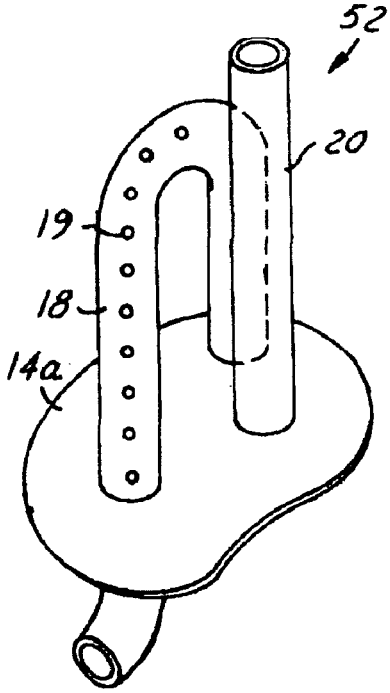

For example, as shown in FIG. 3, the unfilled insert 52 could contain multiple pipes and chambers. Further, as shown in FIG. 4–6, a triangular, round and oval shaped insert section having a single pipe and correspondingly shaped partition is shown. In FIG. 7, a clamshell shaped unfilled insert section 52 having a straight pipe, a curved pipe, and a single partition is shown. As is understood by those of ordinary skill, the shaped tool 50 is thus sized and shaped with appropriate fill openings to correspond to the respective unfilled muffler inserts 52 of FIGS. 4–7.

Referring back to FIG. 2, to fill one or more compartments 16*a*–16*d* with fibrous material 24 to form the filled muffler insert 70, the nozzle 30 is inserted into a respective fill opening 56 contained within that respective portion of the shaped tool 50. Further, a vacuum adapter 40, coupled to a vacuum source 42 via a hose 44, is inserted into the end 60 of one of the respective pipes 18, 20, 22 (in FIG. 2 the vacuum source is coupled to pipe 18) of the shaped tool 50. A plug 46 is inserted into the end portion 62 of the other pipes 18, 20, 22 (as shown in FIG. 2, pipes 20 and 22 are plugged) so as to prevent air or gases from entering or leaving the muffler shell 12 through the pipes 18, 20, 22. When the vacuum source 42 is activated, a partial vacuum is created within the compartments 16*a*–16*d* of the shaped tool 50. Prior to or after activation of the vacuum source 42, continuous strand material 24*b* and pressurized air are supplied to a texturizing device 32. The pressurized air is supplied from a conventional compressor 48 which communicates with the device 32 via a hose 48*a*. The continuous strand material 24*b* comprises one more strands each which may comprise a plurality of glass filaments selected from the group consisting of E-glass filaments and S-glass filaments. Preferably, the continuous strand material comprises a roving sold by Owens Coming under the trademark ADVANTEX® or the trademark Zentron®. The pressurized air separates and entangles the filaments of the strand material 24*b* so that the strand material emerges from the nozzle 30 as a continuous length of "fluffed-up" or fibrous material 24. Once the fibrous material 24 fills the desired compartments 16*a*–16*d*, it defines a wool-type product 24*a* in the compartments 16*a*–16*d*.

Figure 8:
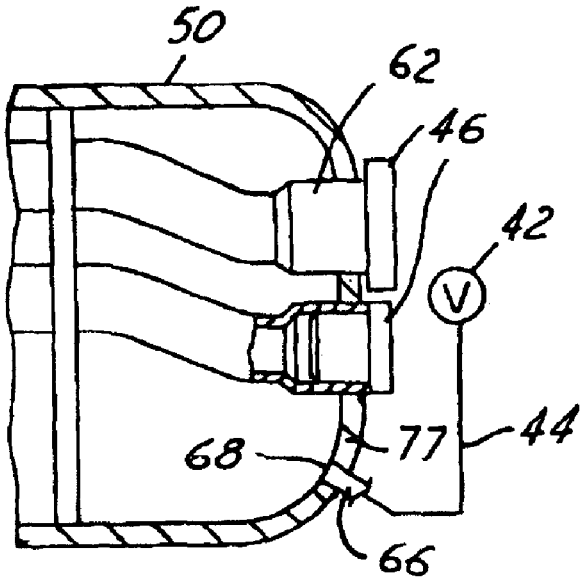
FIG. 8 is a perspective view of a shaped tool and filled muffler insert according to another preferred embodiment of the present invention.

In alternative embodiments, one of which is shown in FIG. 8, the vacuum source 42 could also be coupled anywhere along the bottom region 77 of the shaped tool 50 within the lowest compartment 16*a*–16*d* and not associated with the pipes 18, 20, 22, wherein the end portion 60, 62 of all of the pipes 18, 20, 22 are covered with plugs 46. Thus, for example, extra perforations 66 or through regions 68 in the shaped tool 50 may be provided wherein the hose 44 of the vacuum device 42 may be sealingly engaged so as to provide a sufficient vacuum to allow filling of one or more of the compartments 16*a–d* with fibrous material 24.

Figure 9:
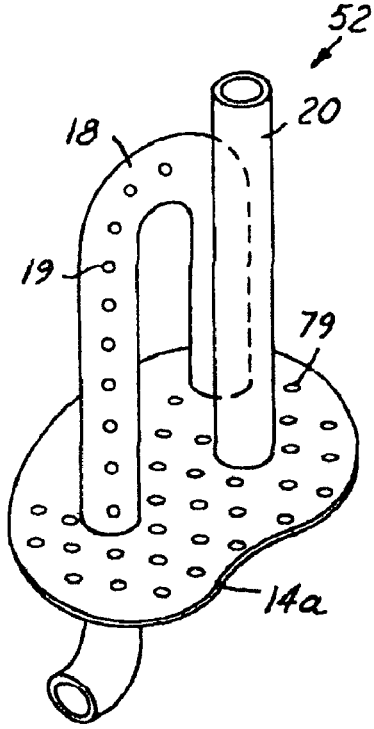
FIG. 9 illustrates a muffler insert having a plurality of perforations on a partition plate according to another preferred embodiment of the present invention.

In yet another preferred embodiment, as shown in FIG. 9, one or more of the partitions 14*a–c* of the insert 52 may be formed with perforations 79 that allow further vacuum effect to enhance the filling of the respective partitions 14*a–c*.

A sufficient quantity of fibrous material 24 is provided in one or more of the compartments 16*a*–16*d* so as to allow the muffler 15 to adequately perform its acoustic energy attenuation and thermal insulation functions. The compartments 16*a*–16*d* may be filled with fibrous material 24 having a density of from about 80 grams/liter to about 200 grams/liter and preferably about 100 grams/liter.

After the fibrous material 24 is added within the desired compartments 16*a–d*, the vacuum source 42 and its associated components are removed. The filled insert is then loaded onto a winding device (shown in FIGS. 10 and 11 as 100), wherein a yarn thread 26 is then wrapped around the wool type product 24*a* volume to form a filled and wound muffler insert 71. The method for wrapping the yarn thread 26 around the wool type product volume 24*a* to form the filled and wound insert 71 is described in further detail in FIGS. 10 and 11 below.

The wound yarn 26, in one preferred embodiment, is selected to provide sufficient tensile strength at room temperature such that the filled and wound insert 71 may be handled in subsequent processing steps, including but not limited to transporting the insert 71 or introducing the filled and wound insert 71 within a muffler shell 12 to form a muffler 15. Yarns 26 with sufficient tensile strength have a tensile strength of at least 550 megapascals (MPa) at room temperature. Further, the wound yarn 26 preferably has a very low tensile strength at elevated temperatures (i.e. in or around typical muffler operating temperatures) such that the first use of the muffler 15 within a vehicle will disintegrate the wrapping yarn 26. This disintegration of the wound yarn 26 will in turn lead to a literal explosion of wool product 24*a* within the selected compartment 16*a–d*. Tensile strengths of a maximum of at most about 50 MPa are desired at these elevated temperatures (between approximately 80 and 120 degrees Celsius).

Preferred wound yarns 26 that meet the tensile strength criteria desired above include polymer yarns having a fiber diameter of between about 0.2 and 1.0 millimeters. Two preferred polymer wound yarns having these diameters and meeting the tensile strength requirements polypropylene yarns and modified polyethylene yarns.

Alternatively, the wound yarn 26 may be formed from materials having sufficient tensile strength at room temperatures as described previously and also at elevated temperatures to maintain the fibrous wool type product 24*a* away from the muffler shell 12. This would allow for a double layer of acoustical protection, one of which is provided by the glass contained within the product 24*a*, and one within the air gap created between the product 24*a* and the muffler shell. As such, the wound yarn 26 does not disintegrate at elevated temperatures. One type of wound yarn 26 that meets these criteria is a steel-type wound yarn 26.

The shaped tool 50 may then be removed from the filled and wound insert 71. The filled and wound insert 71 is subsequently placed within a muffler cavity 12 to form the muffler 15 as described below in further detail in FIGS. 12 and 13.

The process and apparatus for wrapping the yarn 26 around the wool type product 24*a* and affixing the yarn 26 to form the filled and wound insert 71 from the filled insert 70 may be done in many different ways with many different apparatus. One preferred winding device is shown in FIGS. 10 and 11, in which the device 100 itself wraps the yarn 26 around the filled insert 70 while holding the filled insert 70 stationary.

Figure 10:
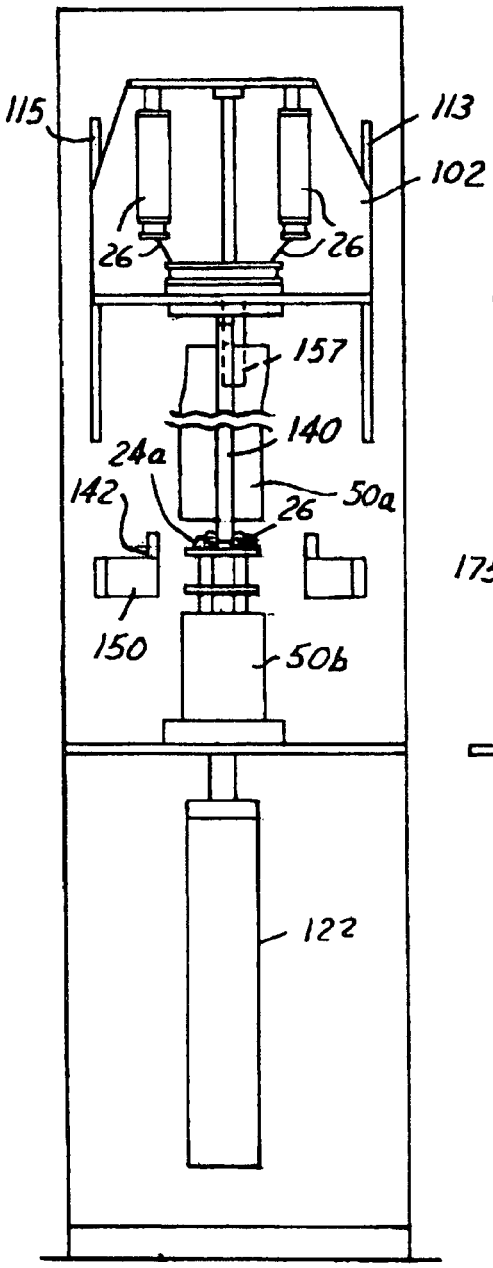
FIGS. 10 and 11 illustrates perspective views of a winding device used to form a filled and wound muffler insert according to a preferred embodiment of the present invention.
Figure 11:
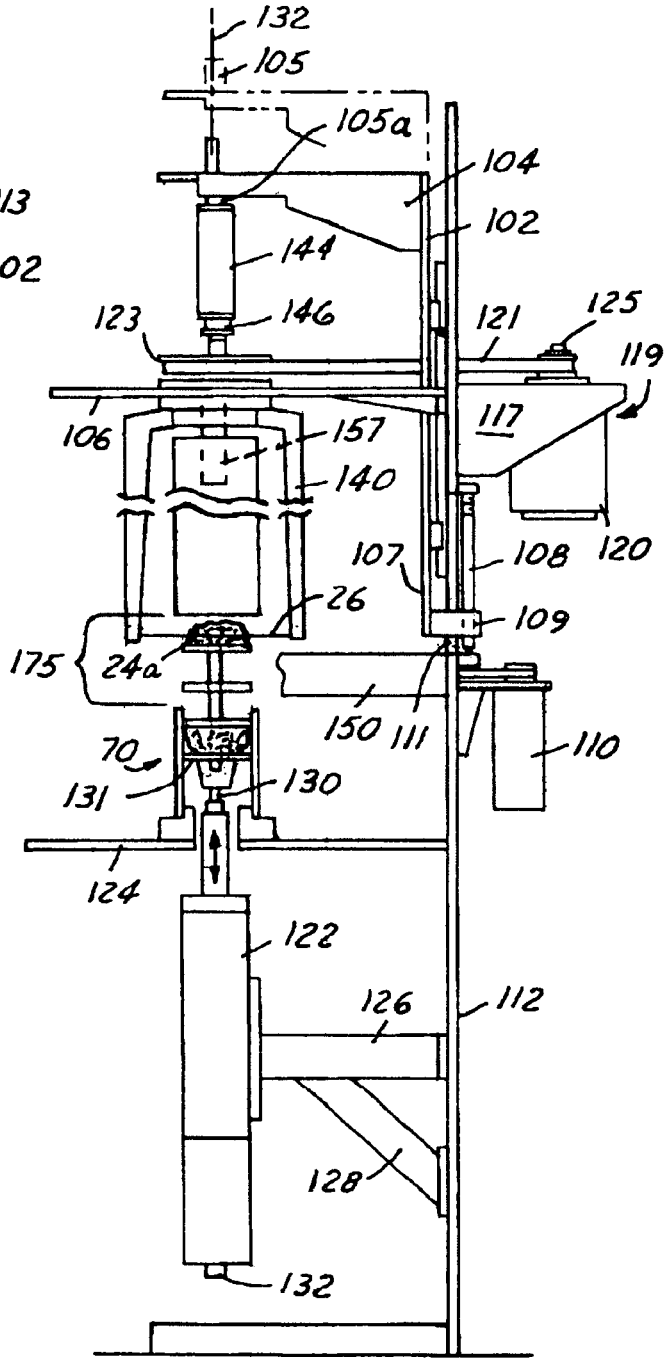

Referring now to FIGS. 10 and 11, a device for winding the yarn thread 26 around the filled insert 70 according to one preferred embodiment is shown generally as 100. The winding device 100 has a vertically movable frame 102 coupled to a stationary base 112. The vertically moving frame 102 has an upper support stage 104 and a middle support stage 106. The upper support stage 104 has a hollow cap 105. An upper cylinder 157 is contained within the hollow cap 105. The hollow cap 105 also has a stage portion 105*a* that surrounds an upper portion of the cylinder 157.

A bottom portion 107 of the frame 102 extends through a first slot 111 of a stationary base 112. The bottom portion 107 has a ring portion 109 having inner teeth (not shown) that are coupled around a tubular worm gear 108 of a rearward drive actuator 110 that is coupled to the vertical base 102. The stationary base 112 also has a pair of vertical side slots 113, 115 that receive a pair of respective back frame supports 117, 119 that extend rearward from the vertically moving frame 102 and are coupled to a drive actuator 110.

The winding machine 100 also has a belt drive actuator 120 having a pulley 125 mounted on its top surface. A belt 121 is coupled to the pulley 125 and to a second pulley 123 contained on top of the middle support stage 106. The actuation of the belt drive actuator 120 rotates the pulley 125, which in turn causes the belt 121 to turn to rotate the second pulley 123. The second pulley 123 is hollow and rotates around a center axis 132 defined by the cylinder 157.

Also attached to the pulley 123 is a yarn-guiding frame 140, which similarly rotate in response to the rotation of the pulley 123. A pair of yarn grippers 142 closely associated with the yarn-guiding frame 140 are coupled to a respective arm 150 that are coupled to the stationary base 112.

Also shown is a pair of yarn bobbins 144 having tensioning devices 146 that are coupled to the opposite side of the second pulley 123 from the yarn-guiding frame 140. Yarn thread 26 stored on each bobbin 144 is thus continuously fed from each of the pair of yarn bobbins 144 through the respective tensioning device 146 and yarn-guiding frame 140 to the yarn gripper 142. As one of ordinary skill appreciates, the number of bobbins 144, shown in FIGS. 10 and 11 as a pair of bobbins, may vary from one bobbin to three or more bobbins depending upon numerous factors, including the size of the muffler insert 24, the space limitations within the winding machines 100, the rotational speed of the belt drive actuator 120, the efficiency of the winding mechanism, the desired winding thickness of the yarn thread 26, or numerous other factors known to those of ordinary skill in the art.

Coupled beneath the lower stage 124 is an actuator 122. The actuator 122 is supported to the rearward mounting structure 110 by supports 126, 128. A lower cylinder 130 is coupled to the actuator 122 and extends upwardly through the lower stage 124. The lower cylinder 130 is capable of extending upward or downward along a center axis 132 defined along the length of the cylinder 130 and cylinder 157 when actuated by the actuator 122.

The process for coupling the yarn 26 around the wool type product 24*a* of the filled insert 70 is accomplished by first activating the actuator 110 to rotate the worm gear 108. The movement of the worm gear 108 in turn causes the ring portion 109 to move the slightly upwardly in response. The upward movement of the ring portion 109 in turn moves the coupled components of the vertically moving frame 102, including the yarn-guiding frame 140, upwardly in response. This creates a gap between the cylinder 157 and cylinder 130 that allows introduction of the shaped insert 50 onto the winding device 100. The shaped insert 50 is then placed onto a circular stage 131 located on the top surface of the lower stage 124, such that the circular stage 131 is either coupled to the bottom of the bottom section 50*b* of the shaped tool 50 or to one of the pipes (here shown as pipe 18). The upper section 50*a* is then coupled to the cylinder 157.

The actuator 110 is then reactivated to move the coupled components of the vertical frame 102 downwardly. As this occurs, the upper section 50*a* of the shaped tool 50 moves downwards until its lower surface remains at a distance of approximately 5 to 20 millimeters above the upper section of the lower section 50*b*. This distance defines a circular gap 175 exposing a portion of the filled insert 70. Yarn 26 is then wrapped around the wool section 24*a* of the filled insert 70 exposed within the gap 175 as described further below.

To begin the winding process, a first end of the yarn 26 from each of the bobbins 144 through the tensioning devices 146 and coupled to the yarn grippers 142. Next, the belt actuator 120 is activated, causing the rotation of the pulley 123, bobbins 144, tensioning devices 146, and yarn guiding frame 140 around the center axis 132. Yarn 26 is then applied around the exposed portion of the filled insert 70. During the application of the yarn 26 the yarn grippers 142 are tilted slightly downward by means of pneumatic or electrical actuators on the arms 150. The grippers 142 then release the yarn 26 for the rest of the application process. Actuator 122 is then activated to move the tube member 130 further upwardly to further wrap yarn around new exposed portions of the wool product 24*a* contained within the gap 175. The combination of both the translation of the filled insert 70 and the rotation of the yarn with the help of the yarn-guide 140 builds a helicoidal path. The step of this path should be defined to avoid the fibrous material having the ability to spring out of its confined volume (minimum: 5 millimeters; maximum: 30 millimeters). The process is continued until the entire wool product 24*a*, or a desired portion of the wool product 24*a*, is sufficiently wrapped in yarn 26. The belt actuator device 110 is then deactivated.

Next, the yarn thread 26 located between the wool product 24*a* and the yarn gripper 142 is cut.

Next, in one preferred method, the end of the yarn 26 created by this cut is then fused to another portion of the yarn 26 wrapped around the wool product 24*a*. Alternatively, the ends from each thread 26 of yarn may be tied together or tied to portions of yarn thread 26 already wrapped around the fiber insert. This forms the filled and wound insert 71.

The fusion step described above is dependent upon the type of yarn thread 26 utilized. For a polymer yarn thread, the end of the yarn preferably is made molten using an ultrasonic welding or hot welding process and stuck to another portion of the thread 26. For a metal yarn, a spot welding process may be utilized.

Alternatively, the yarn thread 26 may be otherwise be affixed around the wool product 24*a* volume by coupling the end portion of the yarn thread 26 within a portion of wool type product 24*a*.

Also, the yarn thread 26 may simply be maintained in place around the wool type product 24*a* without the need to affix the end of the yarn thread 26 to itself or to the wool type product 24*a*. In other words, the yarn thread is self-locking simply by the wrapping mechanism itself without the need to couple the end of the yarn thread 26 to prevent unraveling.

In another alternative embodiment, pins (not shown) may be introduced within the wool type product 24*a*. The yarn thread 26 is then wrapped in one direction (clockwise around center line 132, for example), around the wool type product 24 until encountering the pin. At this time, the yarn thread wraps around the pin and is then wound in the opposite direction (counterclockwise), therein maintaining the yarn thread 26 in place without the need for affixing the yarn thread 26 to itself or to the wool type product 24*a*.

After the filled and wound insert 71 is formed, the actuator 122 and 110 are then deactivated. The shaped tool 50 and filled and wound insert 71 are then removed from the winding device 100 by reactivating the actuator 110 to move upward such that the cylinders 157 and 130 are separated. The shaped tool pieces 50*a*, 50*b* are then separated from the filled and wound muffler insert 71 and discarded.

As one of ordinary skill can appreciate, the winding device 100 shown in FIGS. 10 and 11 could be configured with a wide variety of modifications and still fall within the spirit of the present invention. For example, the yarn 26 maybe applied to the wool product 24*a* wherein the shaped tool 50 and filled muffler insert 70 rotate while the yarn 26 remains substantially stationary. Alternatively, one, three, or more bobbins may be used in place of the dual bobbins 144 shown in FIGS. 10 and 11.

In addition, while the process of introducing the fibrous material 24 to the unfilled insert 50 is shown as an offline process in FIG. 2, the process may actually be performed on the winding device 100 of FIGS. 10 and 11. In this process, the unfilled insert 52 and shaped tool 50 are introduced to the winding device 100 in a manner similar to that shown in FIGS. 10 and 11 with respect to the filled insert 70 and shaped tool 50. The fibrous material 24 is then introduced to the respective compartments 16*a–d* in a manner substantially similar to that shown in FIG. 2 above. After the desired compartments 16*a–d* are filled to form the filled insert 71, the yarn thread 26 may be introduced around the filled insert 71 in a manner described above in FIGS. 10 and 11.

By forming the filled insert on the winding machine 100 as in FIGS. 10 and 11, and not in an offline process as described above in FIG. 2, additional manufacturing cost savings may be realized. For example, storage costs and transportation costs of the filled insert between the filling line and the winding device 100 may be eliminated. Further, less manufacturing floor space associated with having two separate manufacturing lines may be realized. Further, integrated filling and winding components may also be realized.

Figure 12:
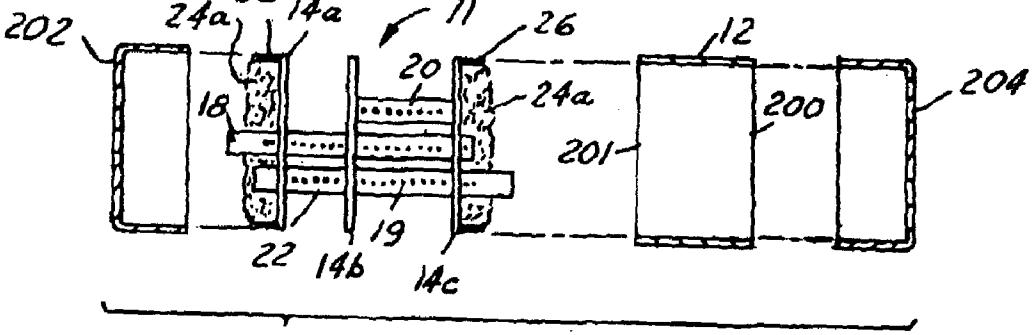
FIG. 12 illustrates a perspective view of one preferred process for introducing a filled and wound insert within a previously formed muffler shell to form the muffler of FIG. 1.
Figure 13:
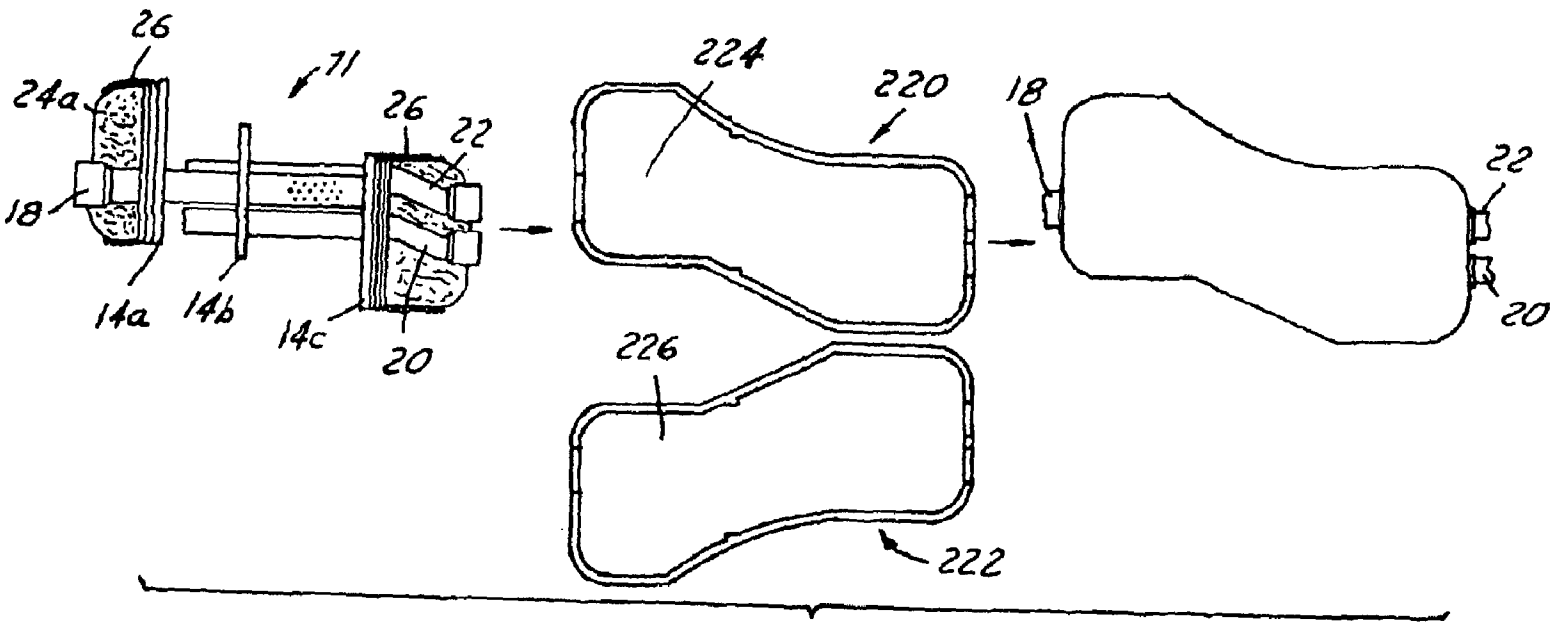
FIG. 13 illustrates a perspective view of a second preferred process for coupling a muffler shell around the filled and wound insert to form the muffler as illustrate in FIG. 1.

The filled and wound muffler insert 71 formed in accordance with FIGS. 10 and 11 is thus available to be placed within a muffler shell 12 to form the muffler 15. Two alternative approaches may be used to achieve this result. In FIG. 12, the filled and wound insert 71 is simply pressed into a previously formed muffler shell 12. In FIG. 13, the muffler shell 12 is formed as two pieces. The filled and wound insert 71 is then placed within the two pieces and the pieces crimped or welded to form the muffler 15. Each is described below.

Referring now to FIG. 12, one preferred method for forming the muffler 15 from the filled and wound insert 71 is shown. In this embodiment, the filled and wound insert 71 having a constant cross section, such as in the embodiments described in FIGS. 3, 4, and 5 above, are pressed within one end 200 of an appropriately sized cylindrical or tubular muffler shell 12 in a method commonly used by those of ordinary skill in the art. An end piece 202 may then be sealingly coupled, via welding or crimping, to the open end 200 of the muffler 12. A second end piece 204 is then coupled to the opposite open end 201 of the shell 12 to complete the assembly.

Alternatively, as shown in FIG. 13, the muffler shell 12 could be formed as two halves 220, 222. The filled and wound insert 71 is placed within the interior region 224 one of halves 220. The other of the two halves 222 is then coupled to the other of the two halves 220 such that the filled and wound insert 71 is contained within the interior region 224, 226 of each of the respective halves 220, 222. The two halves 220, 222 are then sealingly engaged by crimping, welding, or any other method known to those of ordinary skill to form the muffler 15 assembly. The technique as shown in FIG. 13 is used primarily to form odd shaped mufflers 15 such as clamshell mufflers, and thus is used with the embodiments as shown in FIGS. 7 and 9 above. However, the technique may also be used to form cylindrical or tubular mufflers as formed according to FIG. 12 above, and thus may be used in conjunction with the embodiments shown in FIGS. 3–5 above.

The present invention offers many advantages over prior art silencer systems used in mufflers.

For example, the present invention maybe utilized to form mufflers in a wide variety of shapes and sizes not previously attainable in prior art systems. This is important for two reasons. First, while the filling of prior art mufflers with fibrous material was limited to certain geometries, the present invention allows filling of the interior of the mufflers with fibrous material in virtually any geometry. For example, odd shapes such as clam shaped muffler interiors may be easily filled with fibrous material.

Second, the filling of the interior region can be done prior to the build-out of an entire muffler cavity, including the introduction and fixing of internal mechanical parts (pipes and partitions) within the outer shell of the muffler. As stated above, this allows mufflers to be formed in a wide variety of odd shapes and sizes not previously attainable due to space constraints and other considerations. Further, by forming a filled and wound insert, as compared with a filled insert as found in the prior art, damage to the muffler shell during the introduction process is minimized. Also, because the filling process can be done on the winding machine itself, manufacturing cost savings in terms of equipment space, storage, and transportation of filled inserts may be realized.

Further, the behavior of the polymer yarn thread 26 in preferred embodiments of the present invention against temperature are selected to provide optimal tensile strength at room temperature and the lowest possible tensile strength at higher temperatures. Thus, the polymer yarn 26 will disintegrate in the first vehicle use, allowing the wool product 24*a* to expand and fill the compartment in which it is contained, which improves acoustical properties of the muffler 15.

Also, because the polymer yarn 26 is located at a position nearer to the muffler shell and away from the pipes, odor associated with the disintegration of the polymer yarn 26 during first start conditions occurs after the muffler has sufficiently warmed up, thus lessening smoke and odor near the car assembly line.

Also, additional acoustical advantages may be provided in alternative preferred embodiments utilizing steel yarn as the winding. In these systems, the steel yarn compresses the fibrous material against the unfilled insert, therein creating a "double layer" of acoustical properties within the muffler shell contributed by the fibrous material and air gap. This also may enable savings in raw material costs.

Figure 14:
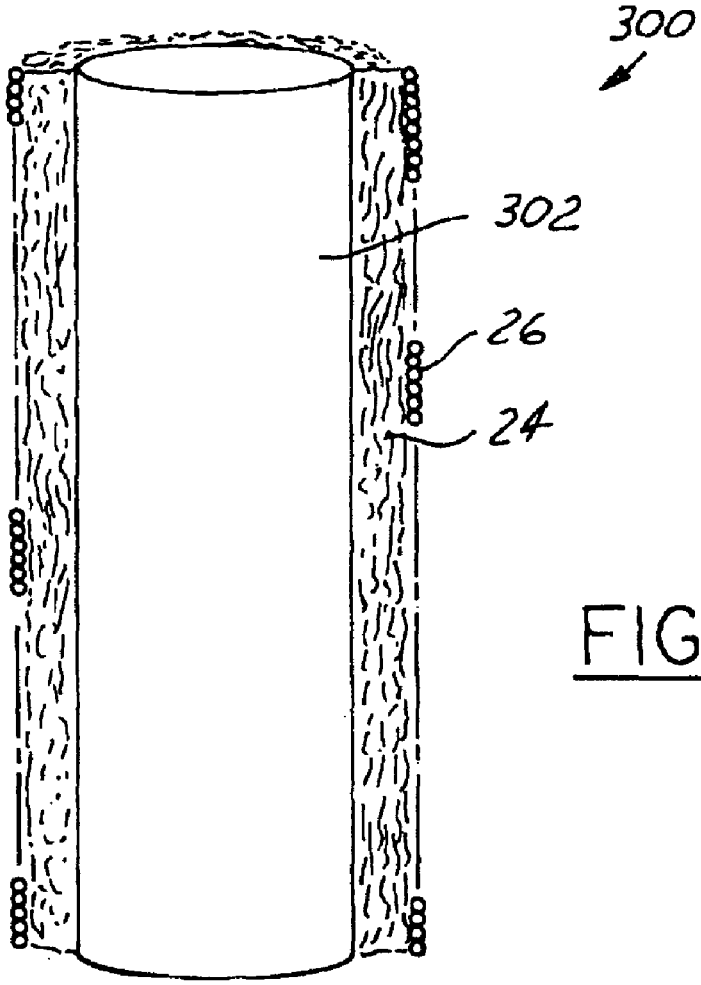
FIG. 14 is a perspective view of a fiber-encased blank according to another preferred embodiment of the present invention.

In another alternative embodiment, as shown in FIG. 14, the technology used to form the filled and wound insert 71 above may also be used to form filled and wound fiber-encased blanks 300. In this embodiment, a core material 302 of metal, plastic, wood, or any other material replaces the unfilled insert 52 of FIGS. 3–7 and 9. The core material 302 is wrapped with fibrous material 24 and wound with yarn 26 in a manner substantially similar to that described above in FIGS. 2, 10 and 11. The composition of the yarn thread 26 should have sufficiently high tensile strength (above 550 mPa) at room temperature and at elevated temperatures to remain wrapped around the fibrous material 24 during storage and during subsequent processing to form the end use application. The blanks 300 may then be used for many applications, including for use as structural reinforcements in any number of applications. To the extreme, this core material 302 could be only in the shape of a temporary double pin. The fibrous material consolidated by the yarn are then pulled off while the assembly (fibrous material 24+yarn 26) remains stable.

While the invention has been described in terms of preferred embodiments, it will be understood, of course, that the invention is not limited thereto since modifications may be made by those skilled in the art, particularly in light of the foregoing teachings.

What is claimed is:

1. A method for forming a muffler insert comprising:
providing a tool having one or more compartments;
introducing a fibrous material within at least one of the compartments to form a wool-type fibrous body;
placing the tool onto a winding machine
wrapping a yarn around at least a portion of the body to form the muffler insert;
removing the tool from the winding machine; and
extracting the muffler insert from the tool.

2. The method of claim 1, wherein introducing a fibrous material comprises:
introducing a nozzle of a texturizing device within a fill opening of the tool; and
introducing one or more strands of a continuous strand material from the texturizing device through the nozzle and into the compartment under vacuum pressure.

3. The method of claim 1, wherein wrapping a yarn comprises:
coupling the yarn contained on the winding machine to a gripper;
rotating a portion of the winding machine around the tool such that the yarn is wound onto the body of fibrous material to form the muffler insert; and
cutting the yarn between the muffler insert and the winding machine.

4. The method of claim 3 further comprising affixing the yarn to the muffler insert.

5. The method of claim 4, wherein affixing the yarn to the muffler insert comprises affixing the end of the yarn to another portion of the yarn.

6. The method of claim 5, wherein affixing the end comprises ultrasonically welding the end to another portion of the yarn.

7. The method of claim 5, wherein affixing the end comprises hot welding the end to another portion of the yarn.

8. The method of claim 5, wherein affixing the yarn to the muffler insert comprises knotting the end of the yarn to another portion of the yarn.

9. The method of claim 4, wherein affixing the yarn to the muffler insert comprises affixing the end within the body of fibrous material.

10. A method for forming a muffler comprising:

providing an unfilled muffler insert;

coupling a tool around a portion of the insert, the tool having an upper section and a lower section, the tool and the insert defining at least one compartment there between;

filling the at least one compartment with a fibrous material such that the material forms a wool-type body within the compartment of the tool;

placing the tool onto a winding machine;

moving the upper section of the tool away from the lower section to create a gap;

wrapping and securing a yarn around a portion of the body of fibrous material exposed within the gap to form a filled and wound muffler insert;

removing the tool and the muffler insert from the winding tool;

extracting the muffler insert from the tool; and coupling the muffler insert within a muffler shell.

11. The method of claim 10, wherein forming the wool-type body comprises:

introducing a nozzle of a texturizing device within a fill opening of the tool;

introducing one or more strands of a continuous strand material from the texturizing device through the nozzle and into the compartment under vacuum pressure.

12. The method of claim 10, wherein wrapping and securing a yarn comprises:

coupling the yarn contained on the winding machine to the body within the gap;

rotating a portion of the winding machine around the body such that the yarn is wound onto the body; and cutting the yarn between the body and the winding machine; and securing the yarn around the body.

13. The method of claim 12, wherein securing the yarn to the body comprises affixing the end of the yarn to another portion of the yarn.

14. The method of claim 13, wherein affixing the end comprises ultrasonically welding the end to another portion of the yarn.

15. The method of claim 13, wherein affixing the end comprises hot welding the end to another portion of the yarn.

16. The method of claim 12, wherein securing the yarn around the filled insert comprises knotting the end to another portion of the yarn.

17. The method of claim 10, wherein coupling the muffler insert within a muffler shell comprises:

providing a muffler shell having a pair of open ends and an interior region;

providing a pair of end pieces;

pressing the muffler insert through the open end and within the interior region;

coupling one of the pair of end pieces to one of the pair of open ends;

coupling the other of the pair of end pieces to the other of the pair of open ends;

sealingly affixing the one of the pair of end pieces to the one of the pair of open ends; and sealingly affixing the other of the pair of end pieces to the other of the pair of open ends.

18. The method of claim 10, wherein coupling the muffler insert within a muffler shell comprises:

providing a muffler shell having an interior region and a first end and second end; and coupling the muffler shell around the muffler insert such that the muffler insert is substantially contained within the interior region and such that the first end substantially abuts the second end; and sealingly affixing the first end to the second end.

19. The method of claim 1 wherein at least one of the one or more compartments includes a perforated pipe.

20. The method of claim 10 wherein the muffler insert includes a perforated pipe.

* * * * *